United States Patent [19]

Stephens

[11] Patent Number: 4,607,699

[45] Date of Patent: Aug. 26, 1986

[54] METHOD FOR TREATING A TAR SAND RESERVOIR TO ENHANCE PETROLEUM PRODUCTION BY CYCLIC STEAM STIMULATION

[75] Inventor: David J. Stephens, Southwell, England

[73] Assignee: Exxon Production Research Co., Houston, Tex.

[21] Appl. No.: 740,613

[22] Filed: Jun. 3, 1985

[51] Int. Cl.[4] ..... E21B 43/24; E21B 43/26

[52] U.S. Cl. ..... 166/303

[58] Field of Search ..... 166/303, 272, 263, 271, 166/274, 308

[56] References Cited

U.S. PATENT DOCUMENTS

| | | | |
|---|---|---|---|
| 3,108,636 | 10/1963 | Peterson | 166/308 |
| 3,358,762 | 12/1967 | Closmann | 166/303 |
| 3,664,422 | 5/1972 | Bullen | 166/283 |
| 3,739,852 | 6/1973 | Woods et al. | 166/303 |
| 3,765,488 | 10/1973 | Pence, Jr. | 166/308 |
| 3,842,910 | 10/1974 | Zingg et al. | 166/305 |
| 3,908,762 | 9/1975 | Redford | 166/263 |
| 4,212,354 | 7/1980 | Guinn | 166/303 |
| 4,217,956 | 8/1980 | Goss et al. | 166/272 |
| 4,374,545 | 2/1983 | Bullen et al. | 166/280 |

*Primary Examiner*—Stephen J. Novosad

*Attorney, Agent, or Firm*—James H. Riley; Karen T. Burleson

[57] ABSTRACT

A method for conditioning the virgin drainage area of a tar sand formation that is penetrated by a well for enhanced petroleum production by cyclic steam stimulation is described. The method comprises fracturing the drainage area by injection of liquid carbon dioxide. While carbon dioxide is still in place within the formation, steam is injected into the formation. After a suitable soaking period, the well is opened to production. This method achieves better petroleum recovery than conventional huff-puff steam stimulation techniques.

8 Claims, 1 Drawing Figure

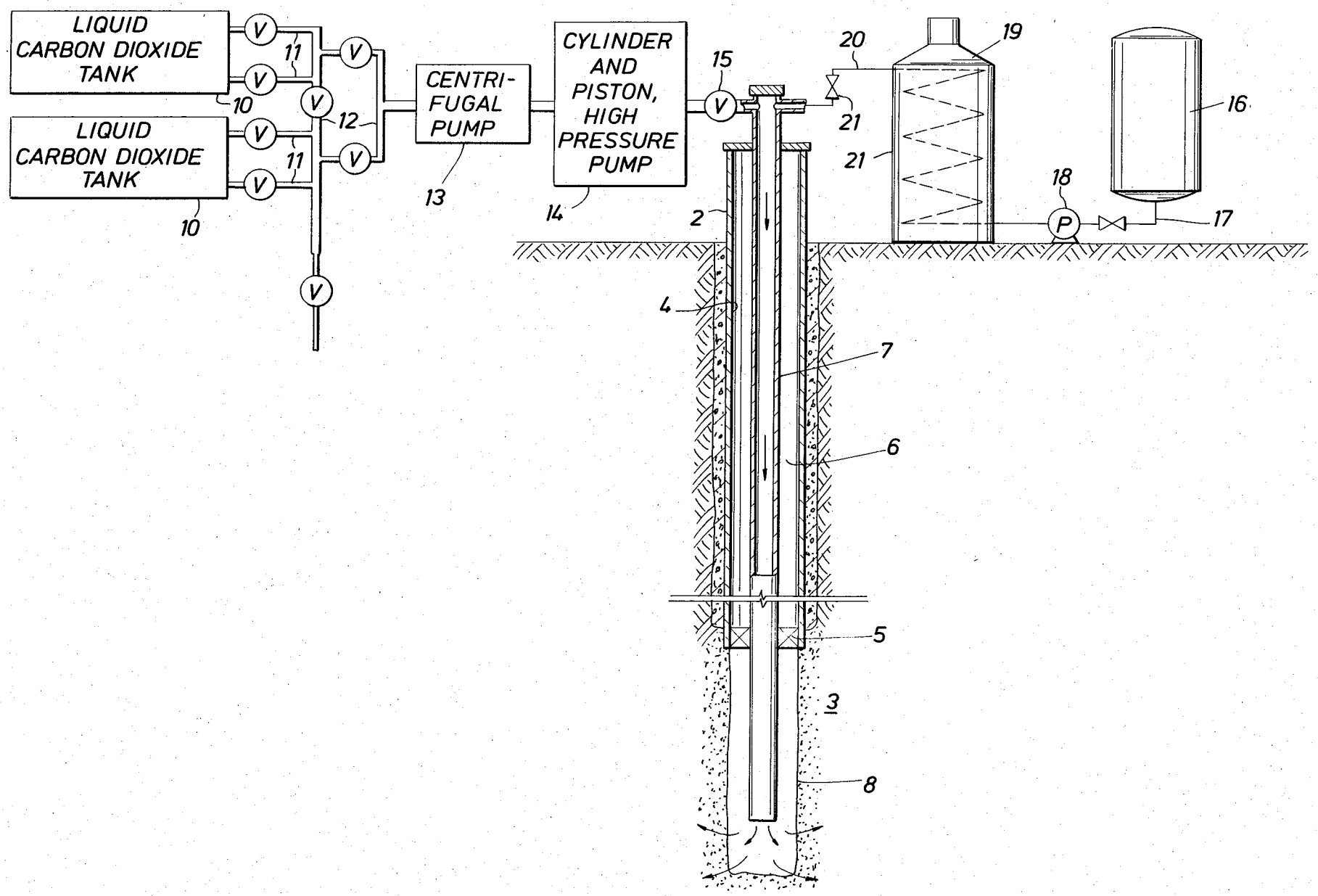
LIQUID CARBON DIOXIDE TANK
LIQUID CARBON DIOXIDE TANK
CENTRI-FUGAL PUMP
CYLINDER AND PISTON, HIGH PRESSURE PUMP
V
P
2
3
4
5
6
7
8
10
11
12
13
14
15
16
17
18
19
20
21

METHOD FOR TREATING A TAR SAND RESERVOIR TO ENHANCE PETROLEUM PRODUCTION BY CYCLIC STEAM STIMULATION

BACKGROUND OF THE INVENTION

This invention relates to a method for treating a virgin drainage area within a subterranean tar sand formation that is penetrated by a well. The invention increases the amount of viscous petroleum that may be produced by cyclic steam stimulation. More particularly, the invention relates to a production method wherein a virgin drainage area within such a formation is fractured by injecting liquid carbon dioxide and stimulated by injecting steam while carbon dioxide is still in place.

Conventional production techniques are ineffective in many substerranean formations because the oil in place has too high a viscosity. The tar sand formations in Canada and the western United States are examples of such problem formations.

A tar sand comprises an essentially unconsolidated sand formation that is saturated with a highly viscous petroleum. The petroleum found in such formations typically has an API gravity in the range of from about 5° to about 10° and is highly bituminous in character. At formation temperatures and pressures, such petroleum possesses a viscosity that may range as high as a million centipoise. Consequently, the mobility of such petroleum within a tar sand formation is exceedingly low.

In tar sand formations where strip mining is not economically or ecologically feasible, various thermal techniques can be used to stimulate the formation for petroleum production. Such techniques include hot water drive, in-situ combustions and steam stimulation. Of these techniques, steam stimulation is the most widely used.

There are two commonly used steam stimulation techniques. One technique employs a steam drive between a steam injection well and one or more production wells. When the permeability of the formation is too low for adequate steam transmission, communication between the injection and production well may be established by hydraulic fracturing. Various improvements have been made in this steam drive technique. U.S. Pat. No. 3,908,762 discloses a procedure for stabilizing the communication path between an injection and production well by injecting a mixture of steam and non-condensable gas, such as carbon dioxide. The inventor asserts that carbon dioxide gas passing through the channel in the presence of steam prevents channel plugging by preventing the resolidification of bitumen within such channels. U.S. Pat. No. 4,217,956 discloses a steam drive technique that uses pressurization and draw down cycles wherein carbon dioxide gas is injected at the beginning of the pressurization cycle. The inventor asserts that the presence of carbon dioxide within the formation during pressurization-draw down cycling causes a better emulsification of oil with steam condensate and facilitates better transport of the oil to the producing well.

The other steam stimulation technique used to produce petroleum from tar sand formations is commonly known as the "huff-puff" technique. In the huff-puff technique, steam is injected through a single well into the formation in quantities sufficient to increase the temperature of the petroleum within the drainage area of the formation such that the petroleum becomes mobile. When the drainage area is of insufficient original permeability to receive adequate quantities of steam, the transmissibility of the drainage area may be increased by conventional hydraulic fracturing techniques. After the requisite quantity of steam has been placed within the formation, the well is shut-in and the formation allowed to "soak" for a period of time. Thereafter, the well is opened to produce the effluent liquids within the steam treated drainage area. U.S. Pat. No. 4,217,956 notes that production by huff-puff stimulation may be increased by injection of carbon dioxide gas at the beginning of a steaming cycle.

U.S. Pat. No. 3,909,762 notes that both steam stimulation techniques can be used on the same formation. For instance, when a communicating well fracture cannot be established between an injection and production well, each well may be treated by a huff-puff procedure involving injection of steam with a non-condensable gas such as carbon dioxide, until such a communication path is established. Thereafter, the steam drive technique is used to produce the formation.

With huff-puff stimulation procedures, peak petroleum production is obtained during the early production cycles. The production level obtained on the first cycle generally dictates whether subsequent cycles will be economical. Thus, it is important to condition the virgin drainage area of a tar sand formation to prepare it for the maximum possible petroleum production during the first cycle of huff-puff steam stimulated production.

SUMMARY OF THE INVENTION

This invention relates to a method for increasing the quantity of oil that may be produced by huff-puff steam stimulation from a virgin drainage area of a tar sand formation. The method comprises fracturing the virgin drainage area by injecting liquid carbon dioxide. While carbon dioxide is still in place within the drainage area, steam is injected into the fractured formation to heat the oil in place. The well is then shut-in, and the formation is allowed to "soak" for a period of time. Thereafter, the well is opened to production of the formation fluids.

BRIEF DESCRIPTION OF THE DRAWING

The drawing illustrates a well that penetrates a tar sand formation. The well has a means for injection of liquid carbon dioxide to fracture the formation and a means for injection of steam to stimulate the formation.

DESCRIPTION OF THE PREFERRED EMBODIMENTS

The method of this invention is applicable to tar sand formations that contain petroleum of such high viscosity that it cannot be produced by primary production methods. The invention provides for a treatment procedure that conditions a virgin tar sand drainage area and allows it to receive greater quantities of steam at faster penetration rates during conventional huff-puff steam stimulation procedures. The invention also increases the area that may be effectively stimulated by such procedures.

Treatment of a virgin drainage area in accordance with the method of the invention increases the amount of petroleum that may be produced from such area by huff-puff steam stimulation, especially during the first production cycle. As used herein, the term "virgin drainage area" is intended to describe that area within a tar sand formation that has not been subjected to a hydraulic fracturing procedure or to a thermal stimulation procedure.

In the practice of this invention, the virgin drainage area that surrounds a completed well is conditioned for huff-puff steam stimulation by fracturing it with liquid carbon dioxide. Carbon dioxide injection is discontinued after the drainage area has been fractured, and steam injection is commenced while carbon dioxide is still in place within the formation.

Fracturing the drainage area with liquid carbon dioxide enhances production during huff-puff steam stimulation in two ways. First, at least a portion of the liquid carbon dioxide dissolves in the oil around the fracture channels, lowering the oil's viscosity and rendering the formation area adjacent to the fracture more receptive to steam penetration. Second, the carbon dioxide that is undissolved in the formation is driven deeper into the formation by the steam and softens even more oil ahead of the steam front. Also, oil that is already softened by dissolved carbon dioxide will tend to release that carbon dioxide when the oil is heated by the advancing steam front. At least a portion of this liberated carbon dioxide advances into new formation areas where it redissolves and softens more oil.

With reference to the drawing, a well 2 penetrates a tar send formation 3. As illustrated, such a well may be of open hole completion, with casing 4 set to the top level of the tar sand formation. A packer 5 is set in the well annulus 6 to isolate the well annulus from the tar sand formation. Production tubing 7 extends through packer 5 and communicates the surface portion of well 2 with the tar sand formation 3.

At the surface, well 2 is provided with means for injecting liquid carbon dioxide into tubing 7 at rates and pressures sufficient to induce fractures and propagate such fractures throughout the tar sand drainage area surrounding well 2. Such rates and pressures will vary depending on the formation conditions, but they can be readily determined by one skilled in the art. U.S. Pat. Nos. 3,108,636; 4,212,354; and 4,374,545 illustrate how some tar sand formations may be fractured.

The fracturing means illustrated in the drawing comprises liquid carbon dioxide storage tanks 10 having suitably valved outlets 11 by which liquid carbon dioxide is fed to a suitably valved manifold 12. A centrifugal pump 13 is connected to manifold 12, and it withdraws liquid carbon dioxide from manifold 12. The liquid carbon dioxide is fed at higher than manifold pressure to the intake of a high pressure positive displacement piston and cylinder pump 14 and is injected through a suitably valved means 15 into well tubing 7.

A typical tar sand drainage area may be fractured by injection of as little as 20 $m^3$ of liquid carbon dioxide. It is preferred, however, that from about 50 $m^3$ to about 100 $m^3$ of liquid carbon dioxide, at a temperature not exceeding about 15° C., be injected into the formation during the fracturing step.

Within the pressure ranges normally experienced during injection into heavy oil sands, it is estimated that liquid carbon dioxide will dissolve in the oil around the fracture in an amount of from about 5% to about 12% by weight. As carbon dioxide dissolves in the formation oil, it reduces the viscosity of a typical tar sand oil by as much as four orders of magnitude. For instance, an API 8° to 12° gravity oil, such as exists in the tar sands found at Peace River and Cold Lake, Alberta, Canada, has an initial viscosity of from about 100,000 to about 1,000,000 centipoise. Fracturing such formation with liquid carbon dioxide will reduce the viscosity of the oil around the fracture to a value of from about 100 to about 1,000 centipoise. Calculated on a fully dissolved basis, about 1,000 $m^3$ of the oil in place will be mobilized within the formation drainage area for each 100 $m^3$ of liquid carbon dioxide injected during the fracturing operation.

After all the liquid carbon dioxide has been injected, the fracturing operation is discontinued, and the well is prepared for steam injection. As illustrated in the drawing, the well is provided with means for generating steam for injection into the well. The steam generation means comprises a feed water supply tank 16 that supplies feed water to steam generator 19 through line 17 and pump 18. Generator 19 supplies steam to line 20 which has a suitably valved means 21 for injection of high pressure, high quality steam into well tubing 7.

Steam is injected through the well at a pressure sufficient to place the steam into the formation through the fractures created by the liquid carbon dioxide. Steam injection is continued until a sufficient amount of steam has been placed within the formation. Depending on the formation conditions, this amount will usually range from about 5,000 $m^3$ to about 10,000 $m^3$. After all the steam has been injected, the well is shut-in and allowed to soak for a period of time sufficient to permit the petroleum contained within the formation drainage area to absorb heat from the steam. Following the soak period, the well is opened to produce effluents from the formation drainage area. After first cycle production has declined to a predetermined level, the well may again be steam stimulated in the manner conventional for huff-puff steam stimulation.

Compared to conventional huff-puff steam stimulation procedures that do not condition the formation drainage area, a well treated in accordance with the method of this invention will yield a greater quantity of produced hydrocarbons on the first and subsequent production cycles. It is expected that the method of this invention will allow the well to have a greater number of economical production cycles.

Although the invention has been described with reference to its preferred embodiments, it is to be understood that, given this description, those of ordinary skill in the art may conceive of modifications or additions thereto that do not depart from the true scope or spirit of the invention as described above or claimed hereafter.

I claim:

1. A method for recovering hydrocarbons from a virgin drainage area of a subterranean tar sand formation that is penetrated by a well, comprising the steps of:

(a) injecting liquid carbon dioxide through said well into said formation at a rate and pressure that is sufficient to fracture said virgin drainage area;

(b) discontinuing the injection of said liquid carbon dioxide after said virgin drainage area has been fractured and, thereafter, while carbon dioxide is still in place within said formation;

(c) injecting steam through said well at a rate and pressure that is sufficient to place said steam into said formation through the fractures in said virgin drainage area;

(d) retaining said steam within said formation for a period of time sufficient to permit said hydrocarbons within said virgin drainage area to absorb the heat from said steam; and, thereafter, (e) opening said well to produce effluents from said virgin drainage area.

2. The method of claim 1, wherein from about 50 $m^3$ to about 100 $m^3$ of liquid carbon dioxide is pumped into said formation.

3. The method of claim 1, wherein from about 5,000 $m^3$ to about 10,000 $m^3$ of steam is injected into said formation.

4. The method of claim 1, wherein the petroleum in said tar sand formation has an API gravity in the range of from about 5° to about 10° prior to injecting said liquid carbon dioxide.

5. The method of claim 1, further comprising repeating steps (c) and (d) after production of effluents according to step (e) has declined below a predetermined level.

6. A method for recovering hydrocarbons from a virgin drainage area of a subterranean tar sand formation that is penetrated by a well, comprising the steps of:

(a) injecting from about 50 $m^3$ to about 100 $m^3$ of liquid carbon dioxide through said well into said formation at a rate and pressure that is sufficient to fracture said virgin drainage area;

(b) discontinuing the injection of said liquid carbon dioxide after said virgin drainage area has been fractured and, thereafter, while carbon dioxide is still in place within said formation;

(c) injecting from about 5,000 $m^3$ to about 10,000 $m^3$ of steam through said well at a rate and pressure that is sufficient to place said steam into said formation through the fractures in said virgin drainage area;

(d) retaining said steam within said formation for a period of time sufficient to permit said hydrocarbons within said virgin drainage area to absorb the heat from said steam; and, thereafter, (e) opening said well to produce effluents from said virgin drainage area.

7. The method of claim 6, wherein the petroleum in said tar sand formation has an API gravity in the range of from about 5° to about 10° prior to injecting said liquid carbon dioxide.

8. The method of claim 6, further comprising repeating steps (c) and (d) after production of effluents according to step (e) has declined below a predetermined level.

* * * * *